US007020298B1

(12) United States Patent
Tziviskos et al.

(10) Patent No.: US 7,020,298 B1
(45) **Date of Patent: *Mar. 28, 2006**

(54) CONNECTOR SYSTEM

(75) Inventors: George Tziviskos, Encino, CA (US); Tom J. Law, Chandler, AZ (US)

(73) Assignee: Advanced Bionics Corporation, Valencia, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/863,563

(22) Filed: Jun. 7, 2004

Related U.S. Application Data

(63) Continuation of application No. 09/785,629, filed on Feb. 16, 2001, now Pat. No. 6,748,094.

(60) Provisional application No. 60/186,858, filed on Mar. 3, 2000.

(51) Int. Cl.
*H04R 25/00* (2006.01)

(52) U.S. Cl. ..... 381/330; 381/322; 381/324

(58) Field of Classification Search ..... 381/322–324, 381/327–331, 380–383; 181/128–130
See application file for complete search history.

(56) References Cited

U.S. PATENT DOCUMENTS

| | | | |
|---|---|---|---|
| 3,123,678 | A | 3/1964 | Prentiss et al. |
| 4,291,203 | A | 9/1981 | Bellafiore |
| 4,727,582 | A | 2/1988 | de Vries et al. |
| 5,606,621 | A | 2/1997 | Reiter et al. |
| 5,824,022 | A | 10/1998 | Zilberman et al. |
| 5,949,895 | A | 9/1999 | Ball et al. |
| 6,748,094 | B1 * | 6/2004 | Tziviskos et al. ..... 381/322 |

* cited by examiner

*Primary Examiner*—Suhan Ni
(74) *Attorney, Agent, or Firm*—Peter K. Johnson; Victoria A. Poissant; Bryant R. Gold

(57) ABSTRACT

A connector system for Behind-The-Ear (BTE) hearing devices provides a means to detachably connect a plurality of earhooks, which earhooks include special earhooks providing auxiliary functions. The connector system includes a coaxial connector mounted on the BTE device, which coaxial connector provides both an earhook mounting fixture, and an electrical connector for auxiliary functions. The auxiliary functions include a telecoil, an auxiliary microphone positioned proximal to an ear canal, an FM receiver, and an input jack for miscellaneous devices. The earhook mounting fixture also accepts standard off-the-shelf earhooks. A friction fit is provided between the earhook and the BTE device so that the angular position of the earhook may be adjusted for a comfortable fit.

20 Claims, 6 Drawing Sheets

CONNECTOR SYSTEM

The present application is a Continuation of U.S. application Ser. No. 09/785,629, filed Feb. 16, 2001 (to be issued as U.S. Pat. No. 6,748,094 on Jun. 8, 2004), which application claims the benefit of U.S. Provisional Application Ser. No. 60/186,858, filed Mar. 3, 2000, both of which applications are incorporated herein by reference in their entireties.

BACKGROUND OF THE INVENTION

The present invention relates to hearing devices for aiding the hearing impaired and the profoundly deaf, and more particularly to a dual purpose connector system providing an attachment system for both a standard earhook and for a special earhook, which special earhook includes auxiliary accessory electrical connection capabilities. The connector system of the present invention is useful for both conventional hearing aids and for cochlear stimulation systems employing Behind-The-Ear (BTE) speech processors.

Implantable Cochlear Stimulation (ICS) systems are known in the art. Such systems are used to help the profoundly deaf (those whose middle and/or outer ear is dysfunctional, but whose auditory nerve remains intact) to hear. The sensation of hearing is achieved by directly exciting the auditory nerve with controlled impulses of electrical current, which impulses are generated as a function of perceived audio sounds. The audio sounds are picked up by a microphone carried externally (not implanted) by the deaf person and converted to electrical signals. The electrical signals, in turn, are processed and conditioned by a Wearable Signal Receiver and Processor (WP) in an appropriate manner, e.g., converted to a sequence of pulses of varying width and/or amplitude, and then transmitted to an implanted receiver circuit of the ICS system. The implanted receiver circuit generates electrical current as a function of the processed signal it receives from the WP (which in turn is based on the audio sounds picked up by the external microphone). The implanted receiver circuit is connected to an implantable electrode array that has been inserted into the cochlea of the inner ear. The electrical current generated by the implanted receiver circuit is applied to individual electrode pairs of the electrode array. It is this electrical current which directly stimulates the auditory nerve and provides the user with the sensation of hearing.

While known ICS systems have succeeded in providing hearing to the deaf, ICS systems also have the disadvantage of appearing unsightly. ICS systems include an external headpiece positioned on the side of the user's head, and require an external cable running from the external headpiece to the WP. The WP is typically worn or carried by the user on a belt or in a pocket. While the WP is not too large, it is likewise not extremely small, and hence also represents an inconvenience for the user. The cable which connects the WP with the headpiece is particularly a source of irritation and self-consciousness for the user.

The above-described aesthetic considerations and inconvenience of an external wire are addressed by U.S. Pat. No. 5,824,022, issued Oct. 20, 1998, for "Cochlear Stimulation System Employing Behind-The-Ear (BTE) Speech Processor With Remote Control." The '022 patent teaches a small single external device that performs the functions of both the WP and the headpiece. The external device is positioned behind the ear to minimize its visibility, and requires no cabling to additional components. The '022 patent is incorporated herein by reference.

While the BTE device taught by the '022 patent resolves the issues of aesthetics and inconvenience, the resulting device leaves little space to provide connectors for auxiliary devices. Typically, users of hearing aids and cochlear implants have requirements to attach a variety of auxiliary devices to augment the basic hearing function. These devices include: telecoils, auxiliary microphones, FM receivers, audio jacks, etc. There is therefore a need to provide a means to reliably and detachably connect an auxiliary device to a BTE device, that does not add size or weight to the BTE device.

SUMMARY OF THE INVENTION

The present invention addresses the above and other needs by providing a connector system for Behind-The-Ear (BTE) hearing devices. The connector system serves as an attachment system for both standard earhooks and for special earhooks, and provides an electrical connection system for auxiliary devices. The connector system comprises a coaxial connector on the BTE device and an auxiliary connector on an earhook. The auxiliary connector on the earhook screws onto the coaxial connector, thus mounting the earhook to the BTE device. The connection of the auxiliary connector to the coaxial connector further provides an electrical connection for a variety of auxiliary devices. The connector system may be utilized as part of either a hearing aid system or a Behind-The-Ear (BTE) speech processor of a cochlear stimulation system.

In accordance with one aspect of the invention, there is provided a threaded coaxial connector protruding from the body of a BTE device for the connection of an earhook. Various sizes and shapes of earhooks are required to comfortably fit a BTE device to a particular user. The connector system of the present invention provides a means to easily attach and remove various earhooks. Advantageously, the threads of the threaded coaxial connector accept either a standard earhook or a special earhook.

It is a feature of the present invention to provide a friction fit between an earhook and the BTE device onto which the earhook is screwed. More particularly, as the earhook is threaded onto the coaxial connector, and as it reaches the final turn of its installation, friction is established between a mating surface on the earhook and a matching surface on the BTE device, such that the earhook remains rotationally fixed over a range of positions. The ability to position the earhook over a range of rotational positions affords a user the ability to position the earhook where it is most comfortable.

It is a further feature of the invention to provide an electrical connector for a variety of auxiliary devices. Such devices include: telecoils, auxiliary microphones, FM receivers, audio jacks, etc. Because the BTE device is small and has limited surface area available for connectors, an appropriate type of connector must be used. An unprotected male connector, for example, would create a risk of snagging on hair and other objects. A female connector would reduce the interior volume of the BTE device available for BTE electronics. Either connector type would result in an unsightly feature on the BTE case. Advantageously, incorporating the auxiliary device electrical connector into the earhook attachment fixture alleviates the need for a separate connector.

It is an additional feature of the invention to provide a natural location for a telecoil. A telecoil, as is known in the art, cooperates with a transmitting coil in a telephone handset to provide a received telephone signal directly to a BTE device. The location of the transmitting coil is generally in the speaker end of the telephone handset. Through the use of a special earhook connectable to the BTE in accordance with the present invention, the telecoil may be positioned in front of the ear and therefore proximal to the transmitting coil in the handset.

Another feature of the invention is that an auxiliary microphone may be positioned proximal to the ear canal. The shape of the ear provides frequency coloring of sound that varies due to the direction the sound arrives from. The frequency coloring enables the brain to determine the direction of sound arrival. By placing an auxiliary microphone near or within the ear canal, the frequency coloring performed by the ear may be exploited and the user may perceive the direction of the sound.

A further feature of the invention is that an FM receiver may be built into an earhook to provide the reception of FM radio signals. FM links are a known method of providing a signal from a remote device to a BTE device, as described in detail in the '022 patent referenced above. Such remote devices include a remote microphone that may be placed near a lecturer for better reception of speech. Placement of the FM receiver in the earhook provides greater freedom in designing the receiver, and isolation from electronics within the BTE device.

A further feature provided by the invention is that auxiliary devices contained in the special earhook are located in front of the ear, and thereby provide better weight distribution than when the auxiliary devices are attached directly to the BTE.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1A:
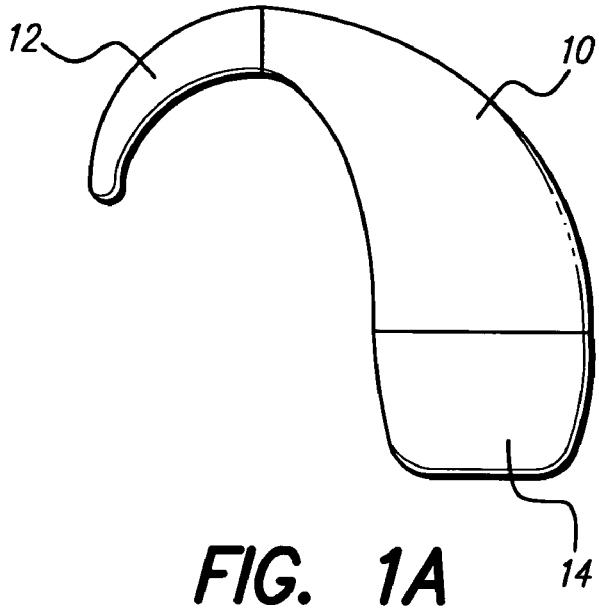
FIG. 1A depicts a complete Behind-The-Ear (BTE) device with earhook and battery attached.

The connector system for Behind-The-Ear (BTE) hearing devices of the present invention provides both a mechanical attachment fixture for standard earhooks and for special earhooks, and an electrical connection for auxiliary devices. As shown in FIG. 1A, when combined (or connected together) a standard earhook 12 and BTE device 10 resemble a common BTE hearing aid. The standard earhook 12 is arched and hooks in front of the ear. The BTE device 10 continues the arch and is positioned behind the ear. A battery compartment 14 is removably attached to the bottom of the BTE device 10. Various batteries of different sizes may be interchangeably attached to the BTE device 10 depending upon the needs of a user. A more detailed description of a BTE device may be found in U.S. Pat. No. 5,824,022, previously incorporated herein by reference. The BTE device 10 is small and fits compactly behind the user's ear, and as a result, there is limited surface area available on the BTE to add connectors. A male connector would risk snagging the user's hair or clothing and a female connector would take up valuable space inside the BTE device that is also needed for BTE electronic circuits. Both male and female connectors would also require covering when not in use to prevent soiling.

Figure 1B:
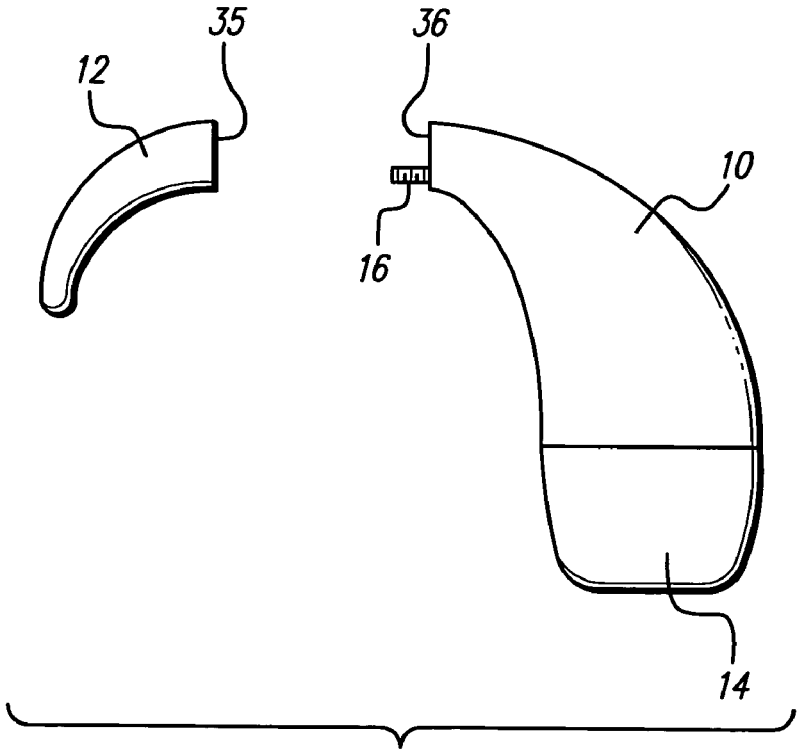
FIG. 1B shows a connector made in accordance with the present invention attached to a BTE device.

Turning to FIG. 1B, a coaxial connector 16 is shown attached to the BTE device 10. The coaxial connector 16 serves as both an attaching fixture for the standard and special earhooks (i.e., provides a mechanical connection), and as an electrical connector for auxiliary devices (i.e., provides an electrical connection between the BTE electronics circuits and other electronic devices or sensors included within, or attached to, an earhook). Advantageously, the dual use feature of the coaxial connector 16 eliminates the need to provide a separate connector for connecting (electrically or mechanically) auxiliary devices to the BTE device 10. The coaxial connector 16 preferably uses the same thread size and pitch as is known for use in standard earhooks, thus allowing the use of standard earhooks with the BTE device. Additionally, an earhook surface 35 and a BTE surface 36 provide a friction fit between the standard earhook 12 and BTE device 10. That is, as the standard earhook 12 is screwed onto the coaxial connector 16, the earhook surface 35 comes into contact with the BTE surface 36 during the final turn of an installation. The resulting resistance or friction resists further turning, and thereby allows the standard earhook 12 to be positioned over a small range of rotational positions. This range positions allows the user to adjust the earhook to a most comfortable position, and the friction fit retains the earhook in that position.

Figures 2A, 2B:
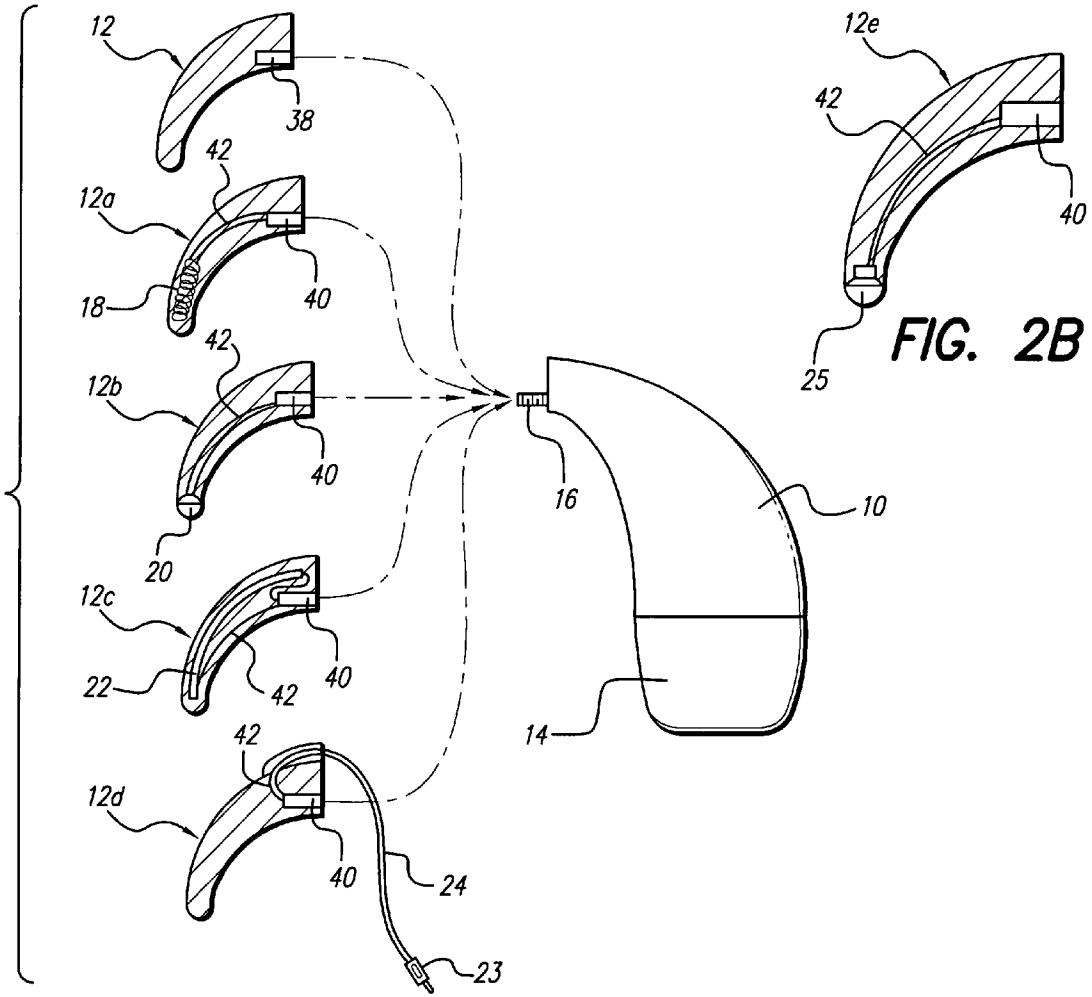
FIG. 2A illustrates cross-sectional views of a standard earhook and four special earhooks, which earhooks may be interchangeably attached to the BTE device.
FIG. 2B illustrates a cross sectional view of a special earhook for use with conventional BTE, or other hearing aid devices, that positions a receiver (speaker) proximal to the ear canal.

A plurality of special earhooks may be used to provide auxiliary functions to the BTE device 10, as shown in FIG. 2A. The standard earhook 12 comprises a bore 38 threaded to receive a standard sized thread. The standard earhook 12, with its threaded bore 38, screws on to the coaxial connector 16 to mount the earhook, just like a nut screws onto a bolt.

The standard earhook 12 contains no electronics or other auxiliary components that require an electrical connection.

Still referring to FIG. 2A, a special earhook 12*a* has a telecoil 18 embedded within the earhook. An auxiliary connector 40 is also included as part of the special earhook 12*a*. The auxiliary connector 40 both screws onto the coaxial connector 16 to mechanically mount the special earhook, and provides an electrical connection for leads 42 running from the telecoil 18 to the auxiliary connector 40.

Yet another special earhook 12*b*, also shown in FIG. 2A, includes an auxiliary microphone 20 mounted near the tip of the earhook (i.e., the end of the earhook opposite the BTE device). Wires or leads 42 electrically connect the microphone 20 to the auxiliary connector 40.

As further seen in FIG. 2A, another special earhook 12*c* has an FM receiver 22 embedded therein. Wires or leads 42 electrically connect the FM receiver 22 to the auxiliary connector 40.

Another special earhook 12*d*, having a cable 24 extending to an input plug 23 is also shown in FIG. 2A. Wires or leads 42 embedded within the special earhook 12*d* electrically connect the cable 24 to the auxiliary connector 40.

Other auxiliary devices may be similarly connected to the BTE device 10 using special earhooks similar to the special earhooks 12*a*, 12*b*, 12*c*, and 12*d* shown in FIG. 2A. Such other special earhook devices are intended to fall within the scope of the present invention.

Turning next to FIG. 2B, a special earhook 12*e* adapted for use with conventional hearing aids is shown. Known hearing aids utilize a receiver (the hearing aid's speaker) in the body of the hearing aid, and a passage through an earhook to carry the sound to a user. The microphone of the hearing aid is also located in the hearing aid body. Because both the microphone and speaker are physically close to each other, some acoustic coupling (feedback) exists between the microphone and the receiver, thus degrading performance. The special earhook 12*e* shown in FIG. 2B positions the hearing aid receiver 25 (i.e., speaker) near the tip of the earhook, and thus proximal or close to the user's ear, and isolated from the microphone in the hearing aid case. Leads or wires 42 carry the signal from the auxiliary connector 40 to the receiver 25.

Figure 3A:
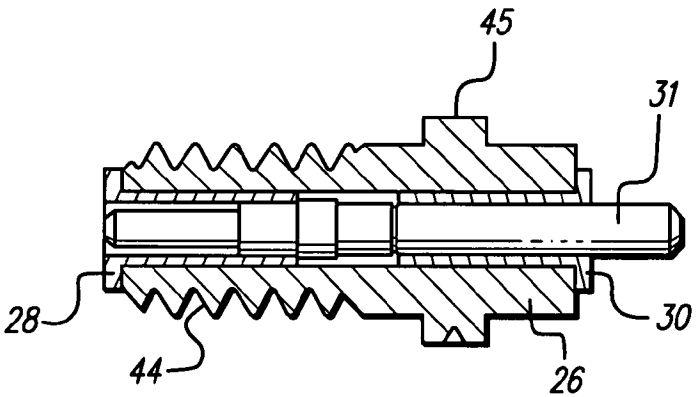
FIG. 3A shows a cross sectional view of the coaxial connector of FIG. 3 taken along line 3A—3A of FIG. 3.
Figure 3C:
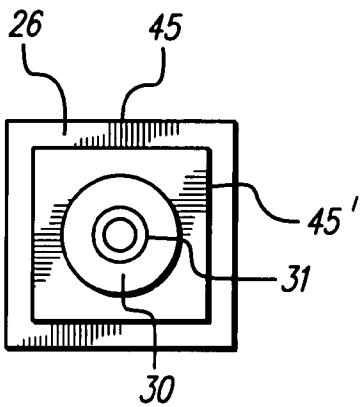
FIG. 3C shows a rear view of the connector of FIG. 3.
Figure 3:
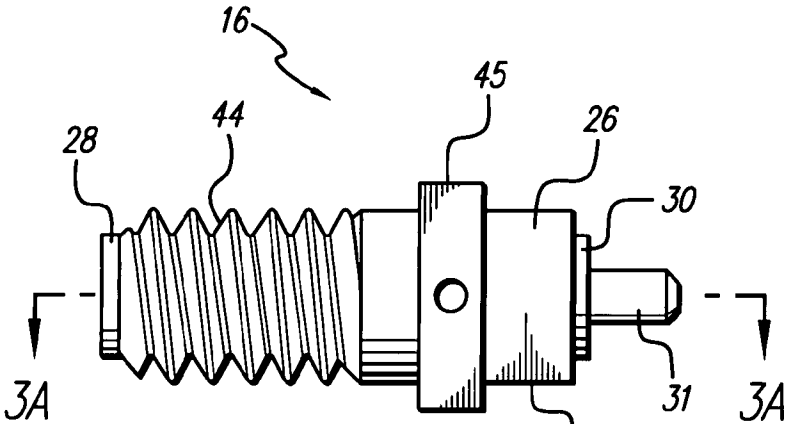
FIG. 3 depicts a coaxial connector made in accordance with the present invention.

A side view of the coaxial connector 16, shown before mounting within the BTE device 10, is shown in FIG. 3. The coaxial connector 16 is mounted in the BTE device 10 such that male threads 44 extend or protrude from the mounting surface 36 (FIG. 1B) of the BTE device 10. A square shoulder 45 at the base of the male threads 44 facilitate mounting the connector 16 within or on the surface 36. Advantageously, using a square shoulder 45 provides a means to rotationally index the coaxial connector 16 relative to the BTE device 10. Such indexing allows a range of frictionally fixed rotational positions of the earhook relative to the BTE device, to be centered on the average position.

FIG. 3A shows a cross sectional view of the coaxial connector 16 taken along line 3A—3A of FIG. 3. The connector body 26 is preferably made of bronze, but may be constructed from other conductive material with suitable mechanical strength and other material characteristics suitable for use as an electrical connector. A cylindrically shaped forward end of the connector body 26 protrudes out from BTE device 10. Male threads 44 are provided on the forward end of the connector body 26 to provide for mounting an earhook to the BTE device 10. The male threads 44 are preferably number 4 machine screw threads with 40 threads per inch, i.e., #4–40 threads. The #4–40 threads are the correct threads for mounting a standard off-the-shelf earhook. Other similar sized threads may be used and are within the scope of the present invention. A passage about 0.050 inches in diameter is provided coaxial with the connector body, to accept a first bushing 28 and a second bushing 30. The bushings are preferably made from PEI resin, but other materials with suitable electrical and mechanical characteristics may be used. A contact assembly 31 is preferably an off-the-shelf battery contact probe, part no. 100803-00, available from Interconnect Devices, Inc., of Kansas City, Kans., or an equivalent contact. The exterior surface of the contact assembly 31 has a diameter of about 0.034 inches, and is insulatedly supported by the bushings 28 and 30. The bushing bore must be sufficiently large to permit easy assembly. The contact assembly 31 protrudes from a rearward end of the connector body 26 and into the body of the BTE device 10, thus permitting an electrical lead within the BTE device 10 to be attached to the contact assembly 31. A second lead within the BTE device 10 may be connected to the connector body 26. The connector body 26, first and second bushing 28 and 30, and contact assembly 31 are assembled with any suitable glue or adhesive.

Figure 3B:
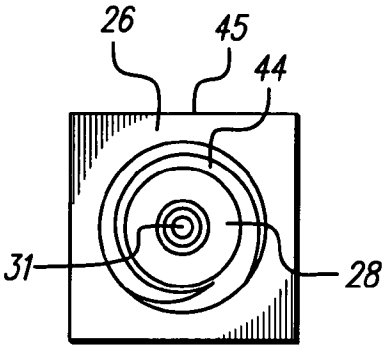
FIG. 3B shows a front view of the connector of FIG. 3.

Now, turning to FIG. 3B, a front view of the coaxial connector 16 is depicted. The square shoulder 45 of the connector body 26 is shown. The square section permits the coaxial connector to be accurately positioned within the BTE device 10, and provides counter rotational resistance.

A rear view of the coaxial connector 16 is shown in FIG. 3C. The square shoulder 45 is shown as well as smaller square step 45', on the rear of the connector body 26.

While the embodiment of the coaxial connector described above uses a connector body as a means for making both a mechanical and an electrical connection, in other embodiments the contact assembly 31 may be replaced by a contact with two or more electrical conducting paths, e.g., a stereo mini-plug. These other embodiments of electrical connectors are within the scope of the present invention. Further, while the threads 44 were chosen to allow a standard earhook to be mounted, other threads could be used.

Figure 4:
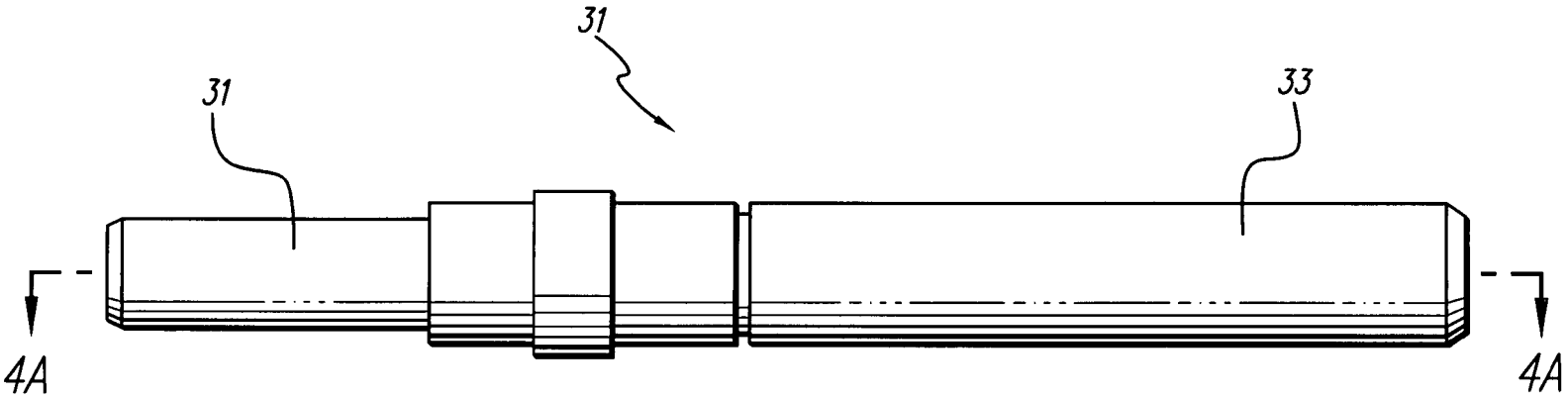
FIG. 4 depicts a contact assembly.

The contact assembly 31 is shown in greater detail in FIG. 4. A plunger 32 protrudes out from an outer shell 33. Both plunger 32 and shell 33 are hollow so as to permit a contact spring 34 (see FIG. 4A below) to be housed therein.

Figure 4A:
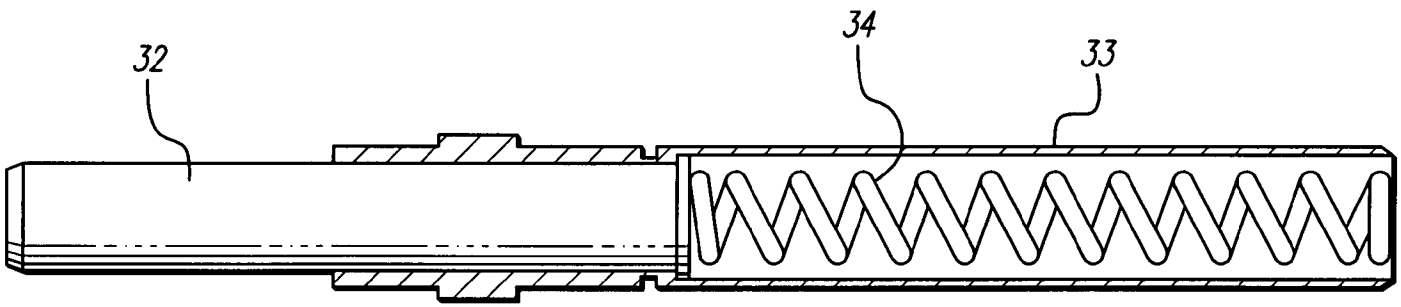
FIG. 4A shows a cross-sectional view of the contact assembly shown in FIG. 4 taken along line 4A—4A of FIG. 4.

FIG. 4A shows a sectional view of the contact assembly 31 taken along line 4A—4A of FIG. 4. In FIG. 4A, the contact spring 34 is shown pushing the plunger 32 out the open end of the outer shell 33.

Figure 5:
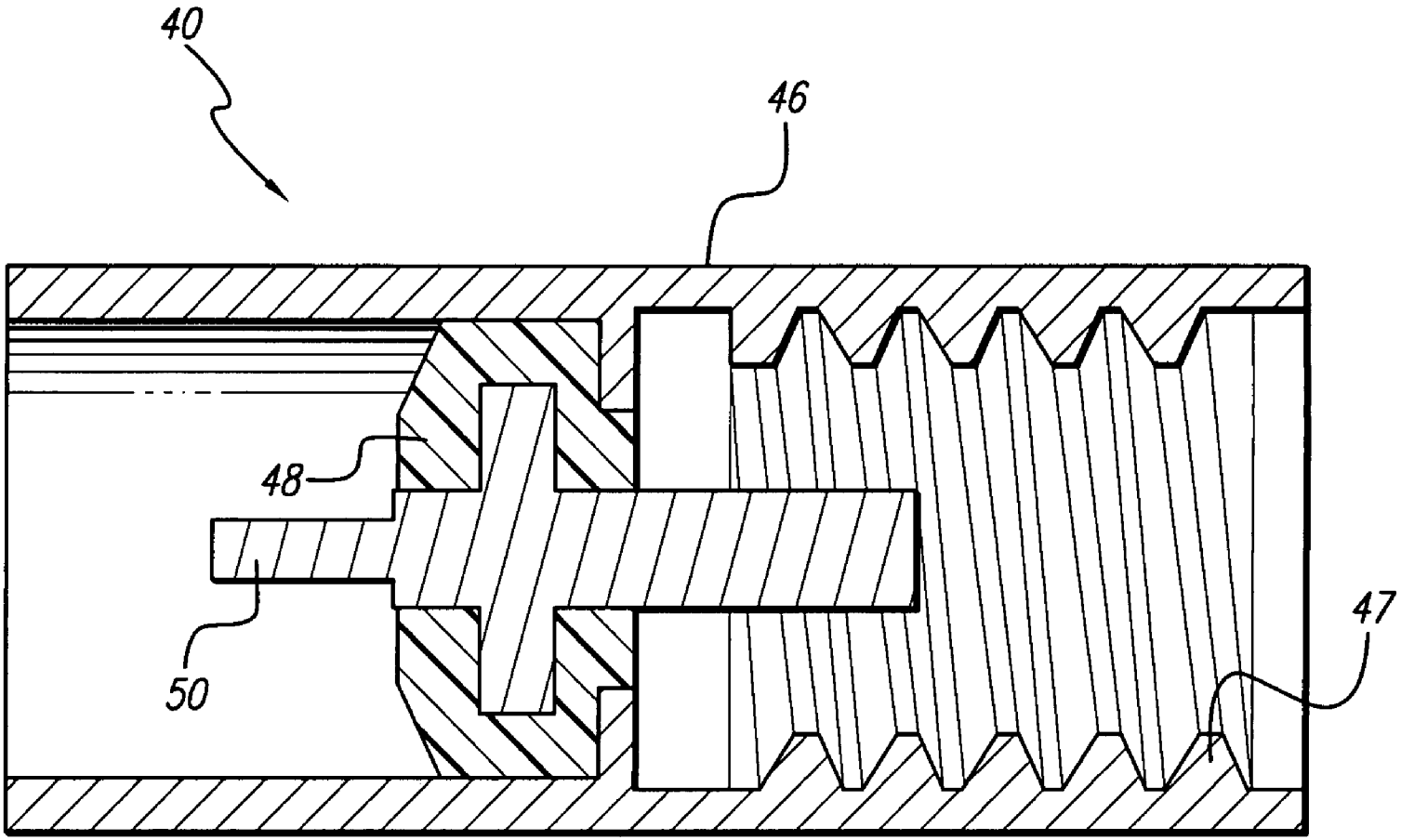
FIG. 5 illustrates an auxiliary connector that may be used in special earhooks in accordance with the invention.

Turning next to FIG. 5, an auxiliary connector 40 is shown. The auxiliary connector 40, as explained previously, is designed to be used within a special earhook, such as the special earhooks 12*a*, 12*b*, 12*c*, 12*d*, and 12*e* shown in FIGS. 2A and 2B. The auxiliary connector 40 is comprised of an auxiliary body 46, an auxiliary bushing 48, and an auxiliary contact 50. The auxiliary body 46 serves both to mechanically and electrically connect a special earhook to the BTE device 10. Mechanical connection is provided through female mating threads 47 that engage with male threads 44 of the coaxial connector 16. A first electrical connection is provided through cooperation of the auxiliary contact 50 and the plunger 32, and a second electrical connection is provided through the cooperation of the auxiliary body 46 with the connector body 26. The auxiliary bushing 48 electrically insulates the auxiliary body 46 from the auxiliary contact 50, and provides physical support for the auxiliary contact 50. When a special earhook is installed on a BTE device 10, the auxiliary contact 50 pushes against the plunger 32, compressing the contact spring 34, thus making a firm electrical connection. Various alternative embodiments of the coaxial connector 16 and the auxiliary connector 40 will be apparent to those skilled in the art and are within the scope of the invention. While the embodiment described here uses the auxiliary body 46 as a means for both a mechanical connection and for an electrical connection, the means for an electrical connection could also comprise a center contact providing two or more electrical paths.

Figure 6A:
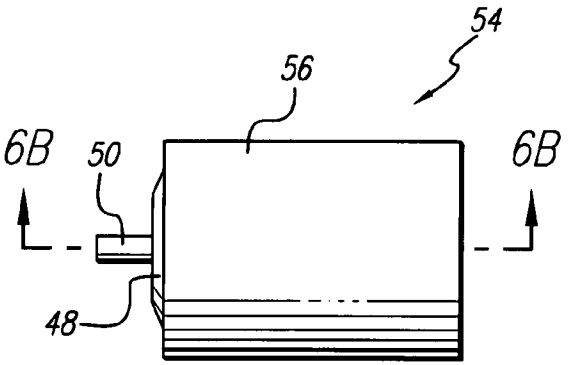
FIG. 6A shows a side view of an alternative auxiliary connector.
Figure 6B:
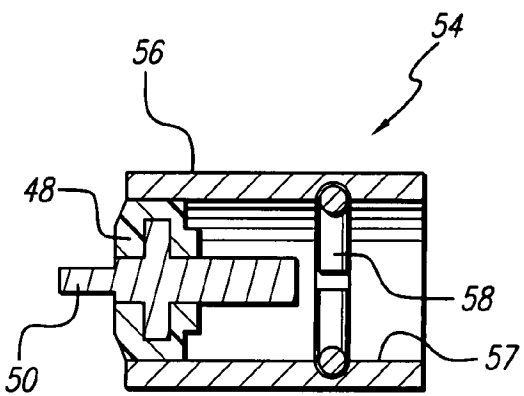
FIG. 6B shows a cross-sectional view of the alternative auxiliary connector of FIG. 6A taken along line 6B—6B of FIG. 6A.
Figure 6:
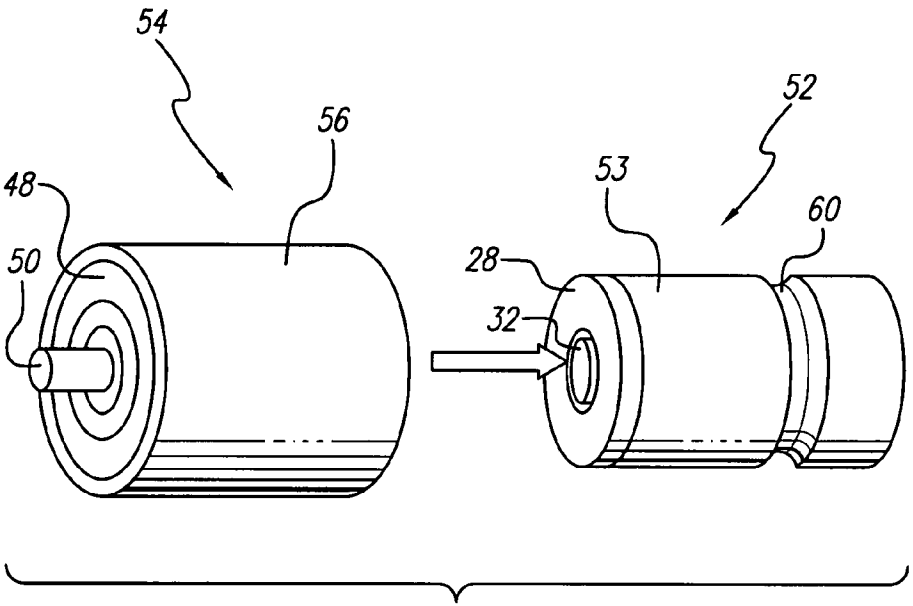
FIG. 6 shows a perspective view of an alternative coaxial connector system comprising a cooperating ring and ring groove as means for earhook retention.

An alternative connector system is shown in FIG. 6. A second coaxial connector 52 is adapted for mounting on the BTE device 10, and a second auxiliary connector 54 is adapted for mounting on an earhook. The coaxial connector 52 has a smooth external surface on its body 53. The auxiliary connector 54 mates with the coaxial connector 52. A ring groove 60 in the connector body 53 provides a latching means for retaining the connectors 52 and 54 in an engaged position.

A side view of the auxiliary connector 54 is shown in FIG. 6A. FIG. 6B shows a cross-sectional view of the auxiliary connector 54 taken along line 6B—6B of FIG. 6A. The auxiliary connector 54 has a body 56 having a smooth inner bore 57 that forms a gas-tight electrical contact with the exterior of the connector body 53. A ring 58 in the interior of the auxiliary body 56 engages the ring groove 60 in the connector body 53, thus providing positioning and retention. The ring 58 may alternatively reside in a ring groove in the male connector and engage a groove provided in the female connector to attach the connectors. Advantageously, when the auxiliary connector 54 is attached to the coaxial connector 52, an infinitely adjustable earhook position is provided. The remaining features of the coaxial connector 52 and the auxiliary connector 54 are substantially similar to the coaxial connector 16 and the auxiliary connector 40 previously described. Those skilled in the art will recognize that other connector types could be used to obtain the interchangeability of earhooks achieved by the present invention. Such other connector type is intended to come within the scope of the present invention.

Moreover, while the coaxial connector of the present invention has been described in the context of its application to a BTE device, it is to be understood that a coaxial connector in accordance with the present invention also has utility to any application where similar requirements exist. These other applications are intended to come within the scope of the present invention.

A connector system providing for the attachment of both a standard earhook and special earhooks has been described herein. The connector system allows a variety of special earhooks, providing auxiliary functions to a BTE device, to be conveniently attached to the BTE device. Further, the connector system is useful for a variety of devices with requirements for a simple and compact method of mechanically and electrically attaching auxiliary devices.

While the invention herein disclosed has been described by means of specific embodiments and applications thereof, numerous modifications and variations could be made thereto by those skilled in the art without departing from the scope of the invention set forth in the claims.

What is claimed is:

1. A connector system for connecting an auxiliary device to an electronic device, comprising a connector and an auxiliary connector, wherein the connector comprises:

a connector body, wherein the connector body is coupled to the electronic device, wherein the connector body is coaxial, wherein the connector body is manufactured from an electrically conducing material, and wherein the connector body includes a means for mechanical attachment to said auxiliary device; and means for electrical connection, wherein the means for electrical connection is electrically connectable to at least one lead within the electronic device; and wherein the auxiliary connector comprises:

auxiliary means for electrical connection, wherein the auxiliary means for electrical connection is connectable to at least one auxiliary lead within the auxiliary device, and wherein the auxiliary means for electrical connection cooperates with the means for electrical connection, thereby providing an electrical connection between the at least one lead within the electronic device and the at least one auxiliary lead within the auxiliary device.

2. The connector system of claim 1 wherein the means for mechanical attachment is suitable for attachment of a standard Behind-the-Ear (BTE) earhook.

3. The connector system of claim 1 wherein the auxiliary device comprises a special earhook, wherein the electronic device is a Behind-the-Ear (BTE) device, and wherein the special earhook provides the ergonomic function of a standard earhook and also provides auxiliary functions to the BTE device.

4. The connector system of claim 3 wherein the special earhook provides an electrical connection between the BTE device and an auxiliary device comprising at least one of a telecoil, an auxiliary microphone, an FM receiver, and an input plug.

5. The connector system of claim 1 wherein the electronic device is a Behind-the-Ear (BTE) device, wherein the means for electrical connection includes the connector body, wherein the connector body is manufactured from an electrically conducting material, and wherein the connector body is electrically connectable to at least one of the at least one lead within the BTE device, and wherein the auxiliary means for electrical connection includes an auxiliary body, wherein the auxiliary body is manufactured from an electrically conducting material, and wherein the auxiliary body is electrically connectable to at least one of the at least one auxiliary lead within the auxiliary device.

6. The connector system of claim 1 wherein the means for electrical connection includes a contact insulatedly attached to the connector body, wherein the contact is electrically connectable to at least one of the at least one lead within the electronic device, and wherein the auxiliary means for electrical connection includes an auxiliary contact insulatedly attached to the auxiliary body, and wherein the auxiliary contact is electrically connectable to at least one of the at least one lead within the auxiliary device.

7. The connector system of claim 6 wherein the connector is a coaxial connector wherein the contact coaxially resides within the connector body.

8. The connector system of claim 7 wherein the contact is insulatedly supported within the connector body by at least one connector bushing, wherein the at least one connector bushing is made from a non-electrically conducting material.

9. The connector system of claim 8 wherein the connector protrudes from the electronic device, and wherein the connector body has a forward end protruding from the electronic device and a rearward end opposite the forward end, and wherein the at least one connector bushing comprises a first bushing at the forward end and a second bushing at the rearward end.

10. The connector system of claim 9 wherein the first bushing and the second bushing are made from Polyetherimide resin (PEI).

11. The connector system of claim 1 wherein the electronic device is a Behind-the-Ear (BTE) speech processor of an Implantable Cochlear Stimulation (ICS) system.

12. The connector system of claim 1 wherein the connector body comprises a cylindrically shaped forward end protruding away from the electronic device and wherein the means for mechanical attachment comprises a ring groove around a diameter of the forward end.

13. A connector system providing both mechanical and electrical connection between an electronic device and an auxiliary device comprising:

a coaxial connector comprising:

a connector body attachable to the electronic device, wherein the connector body includes a means for attaching, and wherein the connector body is connectable to at least one of at least one lead within the electronic device, and an electrically insulated contact configured to reside within the connector body, wherein the contact is connectable to at least one of the at least one lead within the electronic device, and an auxiliary connector comprising:

an auxiliary body attachable to the auxiliary device, wherein the auxiliary body includes an auxiliary means for attaching, and wherein the auxiliary device is removably attachable to the electrical device by cooperation of the means for attaching with the auxiliary means for attaching, and wherein the auxiliary body is connectable to at least one of at least one lead within the auxiliary device, and wherein the auxiliary body electrically cooperates with the connector body providing a first conducting path of an electrical circuit;

an electrically insulated auxiliary contact configured to reside within the auxiliary body, wherein the auxiliary contact is connectable to at least one of the at least one lead within the auxiliary device, and wherein the auxiliary contact cooperates with the contact providing a second conducting path of an electrical circuit.

14. The connector system of claim 13 wherein the connector body has a cylindrical forward end that protrudes outward from the electronic device, wherein the means for attaching comprises external threads on the forward end, and wherein the auxiliary body includes a cylindrical void extending from the surface of the auxiliary body inward, and wherein the auxiliary means for attaching comprises mating threads in the cylindrical void, and wherein the auxiliary device is attached to the electrical device by screwing the auxiliary body onto the connector body.

15. The connector system of claim 14 wherein the contact is a contact assembly comprising:

a cylindrically shaped outer shell with an open end and a closed end;

a plunger slidably protruding from the open end of the outer shell, wherein the plunger is captive to the outer shell; and a contact spring contained in the outer shell and extending from the closed end into the plunger;

wherein the plunger is pushed in a direction out of the open end of the outer shell by the contact spring, and wherein the plunger may be returnably pushed within the outer shell against the contact spring; and wherein the connector body further comprises a rearward end that is attached to the first electrical device, and wherein the at least one insulating bushing comprises a first bushing and a second bushing, wherein the first bushing is resides coaxially with the cylindrical forward end in the forward end of the connector body and supports the open end of the outer shell, and wherein the second bushing resides coaxially within the rearward end of the connector body and supports the closed end of the outer shell; and wherein the auxiliary contact comprises a cylindrically shaped member residing coaxial with the cylindrical void, and wherein the at least one auxiliary bushing is a single auxiliary bushing, and wherein the auxiliary contact is held in position by the single auxiliary bushing, whereby the auxiliary contact is aligned with the plunger when the connector and the auxiliary connector are connected, and wherein the auxiliary contact pushes against the plunger thereby making an electrical connection.

16. The connector system of claim 15 wherein the electronic device is a Behind-The-Ear (BTE) device and the auxiliary device is an earhook.

17. The connector system of claim 16 wherein the earhook is a special earhook, wherein the special earhook provides auxiliary functions to the BTE device.

18. The connector system of claim 15 wherein the electronic device is a Behind-The-Ear speech processor of an Implantable Cochlear Stimulation (ICS) system and the auxiliary device is a special earhook, wherein the special earhook provides an auxiliary function selected from a group consisting of a telecoil, an auxiliary microphone, an FM receiver, and an input plug.

19. The connector system of claim 18 wherein the coaxial connector is suitable for attachment of a standard earhook.

20. The connector system of claim 15 wherein the first bushing and the second bushing and the auxiliary bushing are made from Polyetherimide resin (PEI).

* * * * *